United States Patent [19]

Haigh

[11] Patent Number: 4,705,664

[45] Date of Patent: Nov. 10, 1987

[54] RADIANT HEAT VAPORIZING INJECTOR

[75] Inventor: Richard N. Haigh, Lancaster, Pa.

[73] Assignee: Harbiuger Labs, Inc., Denver, Colo.

[21] Appl. No.: 927,076

[22] Filed: Oct. 29, 1986

[51] Int. Cl.[4] ..... C21C 7/02

[52] U.S. Cl. ..... 420/18; 75/58; 266/216

[58] Field of Search ..... 75/58; 420/18; 266/216

[56] References Cited

U.S. PATENT DOCUMENTS

| | | | |
|---|---|---|---|
| 1,931,144 | 10/1933 | Gilbert | 75/93 |
| 2,678,266 | 5/1954 | Zifferer | 75/130 B |
| 3,367,646 | 2/1968 | Robertson | 75/130 BB |
| 3,619,173 | 11/1971 | Parlee | 75/130 |
| 3,880,411 | 4/1975 | Voronova | 75/130 BB |
| 4,312,668 | 1/1982 | Mannion | 266/216 |
| 4,324,587 | 4/1982 | Schlusselberger | 75/130 B |
| 4,415,362 | 11/1983 | Archenholtz | 75/130 B |

*Primary Examiner*—Peter D. Rosenberg
*Attorney, Agent, or Firm*—Martin Fruitman

[57] ABSTRACT

An apparatus and method for injecting magnesium into molten iron. The magnesium is melted and vaporized in an enclosed container located above and heated by the molten iron. The magnesium vapor is then pumped into the molten iron by its own vapor pressure, through a pipe inserted into the molten iron, from which it bubbles through and reacts with the iron. A load cell from which the magnesium container is hung is used to measure the weight loss of magnesium and thereby control the amount of magnesium added to the iron.

14 Claims, 2 Drawing Figures

RADIANT HEAT VAPORIZING INJECTOR

SUMMARY OF THE INVENTION

This invention deals generally with metallurgy and more specifically with treating molten metals with a vapor additive.

The addition of alloying materials to molten metal is common in many processes in the art of metallurgy, and is particularly vital in the production of ductile iron. Magnesium is added during the production of ductile iron, both to help form the required final alloy and to neutralize sulfur content in the iron. However, magnesium is a particularly troublesome metal to add to molten iron because its melting point is much lower than the temperature at which the molten iron is maintained.

Since magnesium metls at approximately 650 degrees C., and boils at approximately 1100 degrees C., when it is added without precautions in solid form to molten iron which is typically maintained at 1600 degrees C., a violent reaction occurs. Such an occurence is typical when any low melting point material is added to a liquid maintained at a temperature much greater than the additive's melting and boiling temperatures.

In industry, several methods are used to overcome this inherent problem of adding magnesium to iron. Perhaps the most common is that of limiting the access of the molten iron to the solid magnesium. This is done by partially enclosing the magnesium in a perforated container thereby slowing the rate of contact with the iron and reducing the violence of the reaction.

Another method uses alloys of magnesium with other materials as the additive for the iron. These alloys have higher melting and boiling temperatures and therefore the reactions are less troublesome.

Both of these commonly used approaches have severe disadvantages which lead to increased costs of production. The special containers not only are expensive to construct, but they also have severe maintenance problems. Regardless of the specific construction, such equipment is continually exposed to the destructive temperatures of molten iron, so that continual maintenance and replacement are required.

The magnesium alloy additive processes are also unsatisfactory, first because the alloys themselves are expensive, but also because they result in the addition of other materials to the iron.

Moreover, all the commonly used processes depend upon predicting the rate of absorption of the solid additive by the molten iron and the degree of absorption is a function of the reaction rate. This task is made extremely difficult by the fact that the rate of reaction varys with the sizes of the pieces of additive which themselves vary as the reaction progresses.

In actual practice, this means that a highly skilled operator must weigh the amount of magnesium being added based on the weight of a molten iron in a vessel and its sulfur content as reported to him, and also make judgments on the weight of magnesium added. Furthermore, in the production environment, this must be done in a limited time to prevent the iron from cooling down too far. The success of the typical process depends greatly on the expertise of the operator, and even the best systems show a very low yield for the ratio of magnesium going into the iron compared to the total amount used.

Another method of adding magnesium to iron which has been described in prior art is that of first converting the magnesium to vapor and then injecting that vapor into the molten iron. Several patents such as U.S. Pat. Nos. 3,619,173; 1,931,144 and 3,367,646 have used vapor injection into molten iron, but each has independently heated the magnesium, probably to better control the rate of supply to the iron. U.S. Pat. No. 3,619,173 by Parlee et al, in fact, even arranges cooling of the magnesium container to better control the process.

Such methods are not in common use, and it would appear that is because the equipment proposed is very complex and expensive. Furthermore, the independent heating sources force the prior systems to be relatively fixed in place and require that the product iron be transported to the vapor or the vapor piped to the iron. Either solution requires specialized equipment which has apparently hindered the use of vapor injection of iron in the industry.

The present invention overcomes the basic drawbacks of adding magnesium vapor to iron by severing the umbilical cord of an independent heat source for the magnesium. By using the existing heat of the molten iron, the present invention permits the addition of magnesium within the restraints of the time and geometry of the production systems which are presently in use.

Moreover, the apparatus of the present invention permits accurate control, not only of the amount of magnesium added to the iron, but also of the rate of the addition of magnesium.

These control features permit very high yield of the magnesium into the iron and thereby significantly reduce the cost of magnesium. Moreover, the ability to accurately control the addition permits automation of the process for the first time.

These benefits are accomplished by suspending a simple vessel holding molten magnesium over the ladle containing molten iron, and having it heated by radiation from the molten iron below. The distance between the magnesium vessel and the iron surface determines the heat input, and it can be easily varied by the cable suspension system by which the magnesium vessel is hung.

Vapor is supplied to the iron by a bubble pipe protruding below the magnesium vessel and into the molten iron, and the rate of vapor flow is controlled by the vapor pressure of the magnesium which is, in turn, controlled by the heat input to the magnesium. Once an iron ladle is treated, the magnesium vessel is easily transported by its crane to another ladle, where its rate of vapor flow is independently adjusted for the weight of iron in the new ladle.

Measurement of the magnesium being added is accomplished by the readout of a load cell in the vessel suspension system. The load cell, which is a standard device for use in conjunction with cable systems, furnishes a continuous reading of the weight it is supporting, and therefore shows how much magnesium has been dispensed from the vessel.

The present invention furnishes, for the first time, a practical and economical system for adding magnesium to molten iron in a controllable and continuously measured manner.

DETAILED DESCRIPTION OF THE INVENTION

Figure 1:
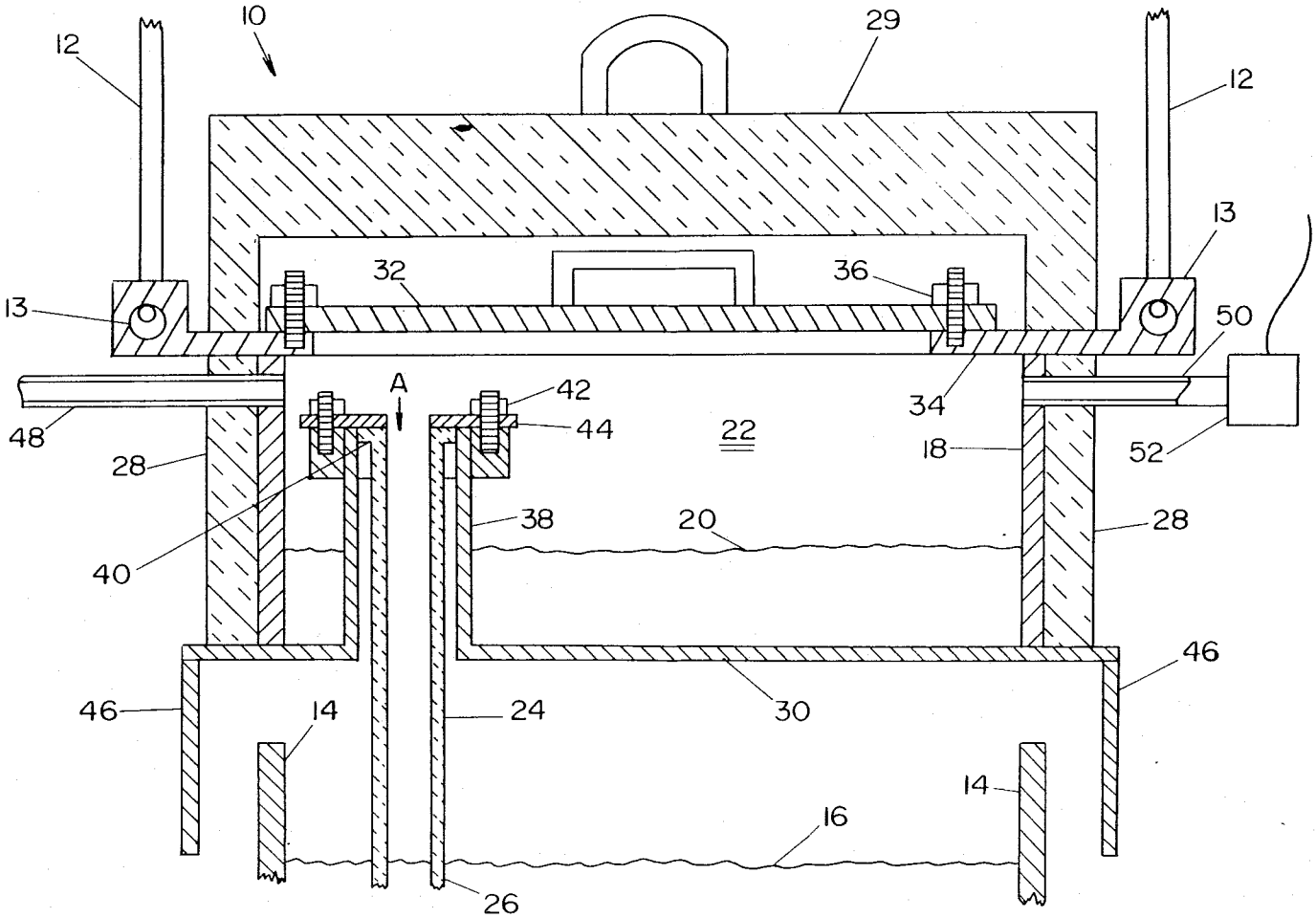
FIG. 1 is a cross section side view of the apparatus of the preferred embodiment of the invention.

FIG. 1 depicts the apparatus of the preferred embodiment of the invention in which magnesium vapor injector 10 is shown suspended by cables 12 and lift holes 13 above ladle 14 containing molten iron 16.

Vapor injector 10 consists essentially of magnesium vessel 18, containing molten magnesium 20 with magnesium vapor atmosphere 22 above the molten magnesium, and vapor pipe 24 extending from vapor atmosphere 22 into ladle 14 and below the surface of molten iron 16.

Vessel 18 is highly insulated with insulation 28 and 29 which is located all around vessel 18 except for vessel bottom 30. Cover 32 is sealed onto vessel top 34 by conventional nut and bolt fasteners 36 to make vessel 18 pressure tight except for path A down through vapor pipe 24.

Vapor pipe 24 is constructed as a reentrant structure to assure that molten magnesium 20 will not leak from vessel 18 even if vapor pipe 24 should break. Vapor pipe 24 which is subject, at least at its lower end 26, to the high temperature of molten iron is typically constructed of refractory material to withstand the extreme temperature. However, since such material is understood to be somewhat fragile, the attachment of vapor pipe 24 to vessel 18 is specifically designed for safety and ease of replacement.

Reentrant tube 38 is constructed as an integral part of vessel 18, and since it is subjected only to the lower temperature of molten magnesium, need not be refractory material. Vapor pipe 24 and reentrant tube 38 are attached only at lip 40 thus permitting vapor pipe 24 to freely expand in length as it is heated. Even the single junction at lip 40 is constructed by the use of conventional fasteners 42 and clamp 44 so that vapor pipe 24 can be easily replaced if such replacement is needed. Once clamp 44 is removed, vapor pipe 24 can be removed simply by moving it straight upward.

Another safety feature of injector 10 is vessel skirt 46. Skirt 46 functions to shield the surroundings from any splashing or bubbling which may occur during the injection of magnesium vapor into the molten iron.

Two penetrations of vessel 18 are constructed to enter near its top well away from the region which is in contact with molten magnesium. Pipe 48 is connectable to an inert gas source. Such gas can be used to flush out the air from vessel 18, so that when magnesium is melted the oxidation of the magnesium is greatly diminished.

Pipe 50 is used to connect pressure transducer 52 to vapor space 22 so that the vapor pressure within vessel 18 may be continuously monitored, and the rate of vapor injection can therefore be determined and controlled.

The preferred embodiment of the present invention which is pictured in FIG. 1 can be used in a simple and straightforward manner to inject magnesium into molten iron during the typical methods now in use for production of ductile iron castings.

To initiate the production, vessel 18 is charged with magnesium by removing insulation cover 29 and vessel cover 32, placing solid magnesium in vessel 18, and resealing cover 32 and recovering it with insulation 29. Since, typically, chunk magnesium takes three times the volume of liquid magnesium, an initial full vessel will yield about a one third liquid fill, and in typical vessel sizes this should be enough for injecting several pouring ladles.

Figure 2:
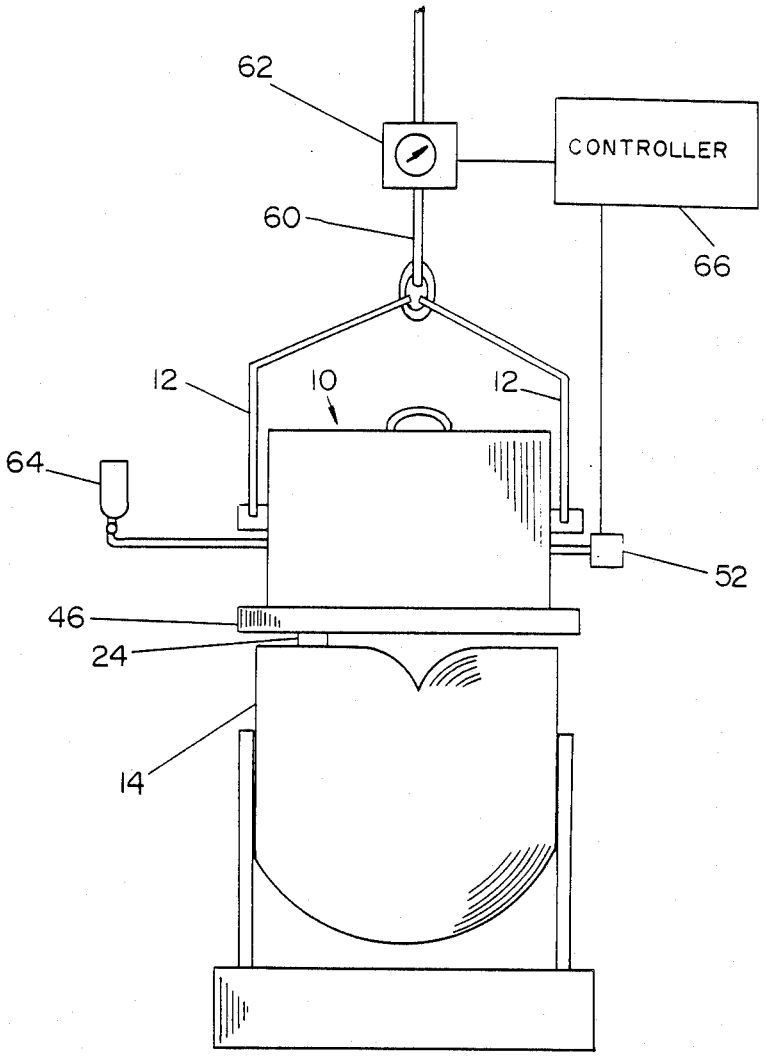
FIG. 2 is a simplified representation of the apparatus of the invention in the process of injecting magnesium into iron.

With injector 10 sealed and insulated it is flushed with inert gas from container 64 and then, as shown in FIG. 2, it is lifted by conventional hoist 60. Load cell 62 is used to continuously monitor the total weight of injector 10.

While it is certainly possible to melt the magnesium by simply placing injector 10 on top of ladle 14 full of molten iron, in a high production system it is more likely that injector 10 would first be placed upon a preheat station so that its magnesium would be melted and vapor pipe 24 brought to temperature while another injector is actually working in the production system.

The preheat station can be either a furnace designed specifically for that purpose or a large container of molten iron from which, in the typical installation, pouring ladles are filled with molten iron.

In either case injector 10 is left in place above a radiant heat source operating at about 1600 degrees C. and is heated until the magnesium liquifies and approaches boiling at approximately 1000 degrees C. The temperature to which bottom 30 of the injector 10 is subjected can be controlled quite simply by the distance bottom 30 is suspended above molten iron 16 and by the length of vapor pipe 24 which is immersed in molten iron 16. The temperature control mechanism is simply a matter of lifting or lowering injector 10 with hoist 60.

A second control factor is the size of the opening in the top of the preheat station. If the molten iron container has a cover over it, at least some opening is required in that cover. However, if time of preheat is not critical, an opening only a little larger than vapor pipe 24 usually will eventually transmit enough heat to vessel 18, by both radiation and conduction along vapor pipe 24, to melt the magnesium.

Once the magnesium is melted, injector 10 can be moved to a location above pouring ladle 14, and to maintain production, another injector can be loaded with magnesium, flushed with inert gas and placed on the preheat station.

As injector 10 is lowered closer to ladle 14, and vapor pipe 24 is immersed below the molten iron surface, the heat applied to injector 10 increases, thereby causing more boiling and a higher magnesium vapor pressure within injector 10. This vapor pressure is measured by pressure transducer 52 and its information is transmitted to controller 66.

Controller 66, to which the weight and composition of the iron in ladle 14 has been communicated, and which is also interconnected with and receives information from load cell 62, controls the hoists mechanism (not shown) to vary the height of injector 10 above ladle 14, thereby automatically controlling the rate of magnesium vapor flow into ladle 14. Moreover, controller 66 can control the total amount of magnesium being injected into the iron.

This is done either by controlling the length of time for which known rates of vapor flow enter the iron, or, even more accurately, by interpreting the information from load cell 62 to determine the actual weight of magnesium which has been removed from injector 10 by vapor flow. Since controller 66 is also receiving information from pressure transducer 52, it is even able to correct for the effect of the lift acting on injector 10 because of the vapor pressure acting downward upon the molten iron through vapor pipe 24.

Although such a correction may seem inconsequential, its need can be better understood when it is appreciated that the weight of magnesium added to the iron is approximately 1.5 pounds for 1000 pounds of iron. With a typical ladle holding about 3000 pounds of iron, that means that less than 5 pounds of magnesium is needed. With the quite considerable weight involved in the equipment, accurate weight measurement is a necessity for proper injection.

It is this high accuracy which gives the injector of the present invention one of its dramatic advantage over the prior art methods. Another advantage is the ability to furnish the required magnesium to a typical pouring ladle in a short enough time, approximately three minutes, so that the existing production processes need not be changed.

But most important, the present invention makes possible a totally portable magnesium injection system which is safe and which requires a minimum of maintenance.

It is to be understood that the form of this invention as shown is merely a preferred embodiment. Various changes may be made in the function and arrangement of parts; equivalent means may be substituted for those illustrated and described; and certain features may be used independently from others without departing from the spirit and scope of the invention as defined in the following claims.

For example, more than one vapor pipe 24 could be used to increase the vapor injection rate.

Moreover, the iron to be treated can be held in a covered furnace rather than an open vessel.

What is claimed as new and for which Letters Patent of the United States are desired to be secured is:

1. An apparatus for injecting a first material of lower melting point into a second material of higher melting point while the second material is in the molten state comprising:

a sealed vessel containing a first material of lower melting point the sealed vessel being located above a surface of a molten second material of higher melting point, at least one surface of the sealed vessel being exposed to heat from the surface of the molten second material;

a passageway attached to the sealed vessel, one end of the passageway being immersed in the molten second material and the other end of the passageway terminating in the sealed vessel at a location which is above the surface of the first material when it is in the liquid state; and a loading means in the sealed vessel which permits loading the first material into the sealed vessel but prevents gas and vapor from leaving the sealed vessel through the loading means.

2. The apparatus of claim 1 further including heat insulation on surfaces of the sealed container other than the surface exposed to heat from the surface of the molten second material.

3. The apparatus of claim 1 further including a support means to locate the sealed vessel above the surface of the molten second material, the support means including means for varying the elevation of the sealed vessel above the surface of the molten second material.

4. The apparatus of claim 1 further including a support means to locate the sealed vessel above the surface of the molten second material, the support means including transport means for moving the sealed vessel from one location to another.

5. The apparatus of claim 1 further including a pressure transducer means interconnected with the sealed vessel and reading the gas pressure within the sealed vessel.

6. The apparatus of claim 1 further including a gas entry means attached to the sealed vessel to furnish a gas atmosphere within the sealed vessel.

7. The apparatus of claim 1 further including a protective shield extending below the sealed vessel to reduce splashing of the molten material.

8. The apparatus of claim 1 wherein the passageway attached to the sealed vessel comprises a pipe passing through the bottom of the sealed vessel, the pipe extending to a height within the sealed vessel sufficient to be above the first material when it is in the liquid state.

9. The apparatus of claim 1 wherein the passageway is removeably attached to the sealed vessel.

10. The apparatus of claim 1 wherein the passageway is attached to the sealed vessel at the upper end of a reentrant attachment to the bottom surface of the sealed vessel with the reentrant attachment extending to a height within the sealed vessel sufficient to be above the first material when it is in the liquid state.

11. The apparatus of claim 1 further including a weighing means for measuring the weight of the sealed vessel.

12. The apparatus of claim 1 further including a controller means interconnected with a pressure transducer which measures the gas pressure within the sealed vessel and with a support means which varies the elevation of the sealed vessel above the surface of the molten second material, the controller means functioning to control the support means so that the elevation of the sealed vessel is varied to control the gas pressure within the sealed container.

13. The apparatus of claim 1 further including a controller means interconnected with a weighing means which measures the weight of the sealed vessel and with a support means which varies the elevation of the sealed vessel, the controller means functioning to control the support means so that the passageway attached to the sealed vessel is lifted out from the molten second material when a prescribed weight reduction has been measured in the sealed vessel.

14. The apparatus of claim 13 further including a pressure transducer which measures the gas pressure within the sealed vessel, the pressure transducer being interconnected with the controller means, and the controller means functioning to correct the weight measurement for the effect of gas pressure.

* * * * *